United States Patent [19]

Waldo et al.

[11] Patent Number: 4,709,445

[45] Date of Patent: Dec. 1, 1987

[54] METHOD AND APPARATUS FOR CLOSING A DOOR

[75] Inventors: Russell W. Waldo, Mendota Heights, Minn.; Cardell E. Miller, Hudson, Wis.

[73] Assignee: Ideal Security Hardward Corporation, Saint Paul, Minn.

[21] Appl. No.: 765,360

[22] Filed: Aug. 13, 1985 (Under 37 CFR 1.47)

[51] Int. Cl.[4] ..... E05F 1/08

[52] U.S. Cl. ..... 16/300; 16/76; 403/146

[58] Field of Search ..... 16/71, 72, 75, 76, 298–301, 16/322; 403/146, 149; 267/58

[56] References Cited

U.S. PATENT DOCUMENTS

| | | | |
|---|---|---|---|
| 521,429 | 6/1894 | Bessonette | 16/322 |
| 2,066,795 | 1/1937 | Moore | 16/70 |
| 2,102,321 | 12/1937 | Keene | 16/76 |
| 3,426,387 | 2/1969 | Bitney | 16/189 |
| 3,510,986 | 5/1970 | Berkowitz | 49/386 |
| 4,050,115 | 9/1977 | Gwozdz | 16/128 |
| 4,514,878 | 5/1985 | Arneberg | 16/300 |

FOREIGN PATENT DOCUMENTS

| | | | |
|---|---|---|---|
| 458995 | 8/1912 | France | 16/300 |
| 2845 | 11/1860 | United Kingdom | 16/300 |

*Primary Examiner*—Donald R. Schran
*Assistant Examiner*—James L. Wolfe
*Attorney, Agent, or Firm*—Merchant, Gould, Smith, Edell, Welter & Schmidt

[57] ABSTRACT

An apparatus for closing a door (14), the door closer assembly (10) preferably including a torsional spring unit (12) and a pneumatic check device (22). The torsional spring unit (12) can be attached to a door frame (16) through the use of a bracket (20) whereas the pneumatic check (22) can be attached to the door (14) through the use of a bracket (24). The amount of closing force generated by the torsional spring unit (12) can be adjusted by tensioning the torsional spring (26); locking the two housing components (34) and (46) together; repositioning the locked housing unit and the door (14); and releasing the housings (34) and (46) to "restore" the formerly stored closing force at a new door position.

8 Claims, 7 Drawing Figures

56
54
52
56
56
56
60
38
58
58
50
60
40
58
90
42
42
62
66
42
74
64
70
72
72
70
34
36
18
68
32
46
75
44
77
44
44
28
30
20
48
76
78
26
48

FIG. 6
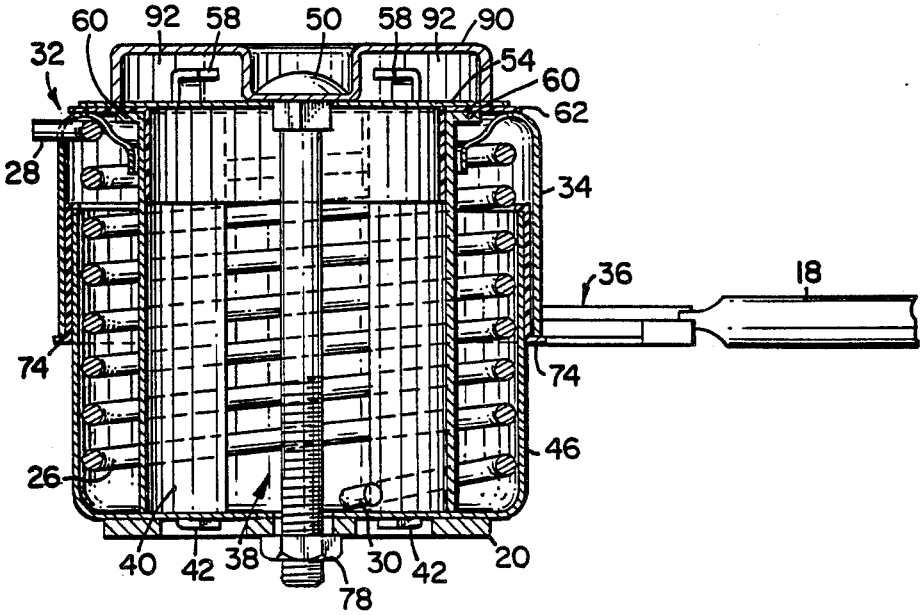
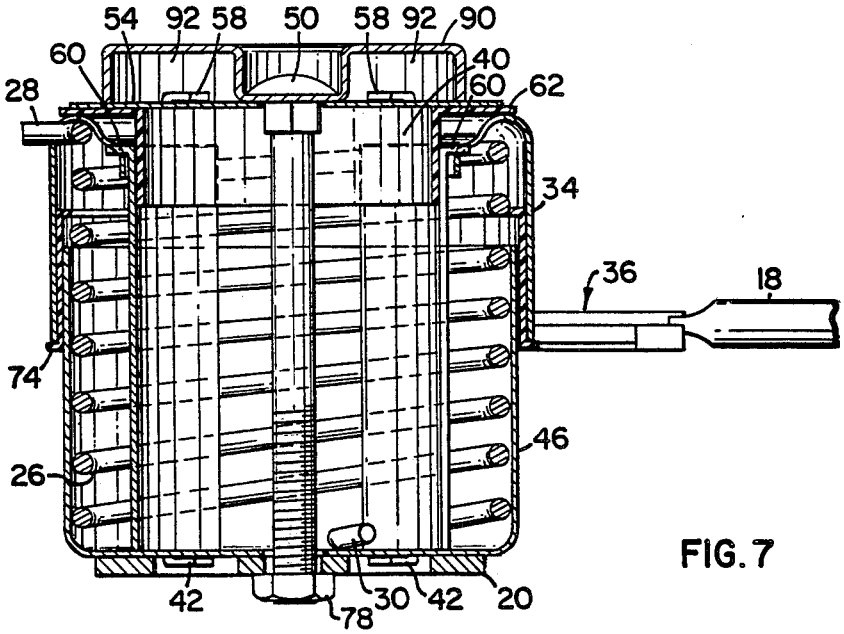
FIG. 7

METHOD AND APPARATUS FOR CLOSING A DOOR

FIELD OF THE INVENTION

The present invention relates generally to methods and apparatus for closing doors. More particularly, the apparatus of the present invention includes a door closer assembly which can be installed on doors to automatically return them to a closed position once they are opened, and which includes means for adjusting the closing force produced by the door closer.

BACKGROUND OF THE INVENTION

Many door closer assemblies are known which will cause a door to close once it has been opened. Many of these devices include either a linear or torsional resilient member which is increasingly distorted as the door is opened. The resilient member, e.g., a spring, generates a closing force which is preferably sufficient to close the door once it has been opened. The terms "spring" and "resilient member" will be used interchangably herein. It should be recognized that the "spring" of a door closer can be any kind of elastic or resilient member, including but not limited to conventional torsional or linear springs.

Generally, the spring of a door closer is interposed between two components or assemblies which are suitable for attaching to a door and a door frame. As the door is opened, the components move relative to one another causing the tension in the spring to gradually increase. As the tension in the spring increases, the closing force generated by the spring increases. The closing force acts on the first and second components to urge the door toward its closed position relative to the door frame. It should be noted that many door closers include a damping device, e.g., a pneumatic door "check," which is designed to control the closing velocity of the door.

It has generally been recognized that it is desirable to make the spring of a door closer adjustable so that the closing force created by the spring can be varied for any given door position. This adjustability feature is desirable in light of the various door weights, hinge designs, weather seal configurations and pneumatic check resistances which a door closer might encounter. If the closing force is too high, it is too difficult to distort the spring to open the door. The very young and the elderly might find it difficult to open the door in such cases. Also, if the closing force is too high, once the door is released it will tend to slam shut unless it is equipped with a check device which dissipates enough energy to adequately control the closing rate.

On the other hand, if the closing force produced by the resilient member of a door closer is insufficient, the door will tend to close too slowly, particularly if it is supplied with a pneumatic check. If the closing force is too weak any friction in the hinges might hinder or even prevent the closing of the door. Similarly, if the closing force is too weak, the door might not close with sufficient momentum to cause full engagement between the door and the weather seal typically carried by the door frame. Frictional forces are apt to increase over the lives of the door components as parts wear and as lubricants become exhausted. Also, temperature variations can detrimentally affect the smooth functioning of the door and associated components.

Thus, it is clear that an adjustable door closer is desirable. Theoretically there are at least two ways to alter the closing force produced by a resilient member of a door closer: the "spring rate" of the resilient member can be altered or the degree of tensioning or pretensioning of the spring can be changed. It is generally impractical to alter a spring's elastic constant. A spring can be readily prestressed, however, and this process typically results in a spring which supplies a closing force between the door and the door frame even when the door is in its fully closed position. Thus, changing the closing force of a door closer's resilient member, e.g., spring, is usually equivalent to changing the degree of pretension which the spring possesses in its closed state.

Door closers which possess the adjustability feature discussed above are generally known. However, the adjustment of known door closers often requires special tools not available to the typical homeowner, for example. Special tools are often needed since the resilient member of the typical door closer is a spring which has a relatively large spring rate. Such a spring typically acts on two components, the first of which might be attached to the door and the second of which might be attached to the door frame. The two components or assemblies are movable relative to one another. Therefore, in order to adjust the closing force generated by the spring a considerable amount of counterforce must typically be generated.

To generate the relatively large forces needed to adjust prior art door closers, the installer of the door often needs a special tool such as a spanner wrench, pin wrench or the like. As noted above, very often such tools are not readily available to the installer. For example, U.S. Pat. No. 4,050,115, issued to Joseph W. Gwozdz, shows a spring-loaded door hinge which can be pretensioned. However, to effect the pretensioning one must unlatch a component and twist a torsion rod and then relatch the component. Thus, the two components of the door closer which are acted upon by the spring remain movable relative to one another during the adjustment process. That is, in order to change the amount of closing force created by the spring the two components must be moved relative to one another while the spring continues to act on the two components. This requires that the person adjusting the hinge resist the closing force of the spring throughout the entire adjustment process.

Similarly, U.S. Pat. No. 3,426,387, issued to R. H. Bitney, shows a spring-loaded hinge which can be adjusted but which requires a spanner wrench for the adjustment process. Again, the two major components or assemblies of the spring-biased hinge remain movable with respect to one another throughout the adjustment process so that the spring tends to rotate them so as to close the door. It is perceived that such a spring, being under considerable tension and having a fairly substantial spring rate, is very difficult to resist or counter during the adjustment process.

To illustrate the difficulty by which many prior art door closers are adjusted, U.S. Pat. No. 2,066,795, issued to W. F. Moore, discloses and adjustment process that requires the holding of one of the components with one hand while the closer is readjusted and reclamped with the other hand. Clearly, this adjustment of the spring's pretension or closing force is difficult at least partly because the two major components or assemblies of the door closer remain movable throughout the adjustment process.

The present invention is directed to the shortcomings of the prior art door closers. More particularly, the door closer of the present invention includes a resilient member which can be easily adjusted to vary its closing force. When adjusting a preferred embodiment of the door closer of the present invention, no special tools are required. Further with regard to the present invention, during the adjustment process the two components acted upon the resilient member are locked so that the person making the adjustment need not work against the spring.

Thus, when the present invention is employed one can freely and easily associate a given spring tension with a plurality of door positions. When the door closer of the present invention is attached to a door and door frame and the door is opened to an arbitrary position, the tension in the spring is increased. This tension can be "stored" or "transferred" so as to be associated with a new door position and subsequently "restored." This "transfers" the tension to a new door position. Therefore, the door closer of the present invention allows one to easily increase or decrease the closing force by substantially eliminating relative motion between the two components which are operatively engaged by the closer's spring during the adjustment process.

SUMMARY OF THE INVENTION

The present invention is a method and apparatus for automatically closing a door. The apparatus of the present invention is a door closer suitable for operatively connecting to first and second door assembly portions, wherein the first door assembly portion can assume first, second and third positions relative to the second door assembly portion.

The door closer includes a first component; a second component, wherein the first component is movable between a first state and a second state relative to said second component; means for operatively connecting the first component to the first door assembly portion; means for operatively connecting the second component to the second door assembly portion, wherein the first component is movable from the first state to the second state relative to the second component in response to movement of the first door assembly portion from its first position to its second position relative to the second door assembly portion when the door closer is operatively connected to the first and second door assembly portions; means for applying a closing force between the first and second components comprising means for changing the closing force from a first closing force to a second closing force upon movement of the first component from the first state to the second state relative to the second component; means operatively connected to the first and second components for selectively locking the first component in the second state relative to the second component, thereby storing the second closing force by substantially eliminating relative movement between the first and second components; means operatively connected to the second component and the second component connecting means for selectively allowing relative movement therebetween, wherein the first door assembly portion can be selectively freely moved from its second position to its third position relative to the second door assembly portion when the door closer is operatively disposed relative to the first and second door assembly portions; and means operatively connected to the first and second components for selectively unlocking the first and second components, thereby selectively allowing relative movement therebetween and restoring the second closing force, wherein the second closing force can be selectively associated with the third position of the first door assembly portion relative to the second door assembly portion when the door closer is operatively disposed relative to the first and second door assembly portions.

In a preferred embodiment, the first door assembly portion includes a door and the second door assembly portion includes a door frame.

Also, the door closer is preferably a torsional door closer having a torsional spring.

Further with regard to the preferred torsional door closer, it preferably includes first and second housing assemblies which substantially encase the torsional spring. A first end of the torsional spring engages the first housing assembly and a second end of the torsional spring operatively engages the second housing assembly. Also, the first and second housing assemblies are preferably slidably engaged and normally rotatable with respect to one another.

Preferably, the first housing assembly discussed above includes a first substantially cylindrical housing coaxially alogned with the torsional spring, wherein the first housing forms a plurality of locking slots and a first spring aperture suitable for receiving the first end of the torsional spring. Also, preferably, the second housing assembly includes a second substantially cylindrical housing and a sleeve fixed thereto. In this preferred embodiment, the locking means includes the sleeve and a locking ear extending therefrom wherein the first and second housings are selectively locked by operatively engaging the locking ear and one of the locking slots formed by the first housing.

Preferably, the locking means further comprises a male threaded member which is axially aligned with the housings, the sleeve and the torsional spring, and a female threaded member positioned on the outside of the housings. In this embodiment, when the male and female threaded members are encasingly threadedly engaged, the first and second housings are axially drawn together to cause the locking ear of the sleeve to operatively engage one of the locking slots formed by the first housing to rotationally lock the first and second housings together to "store" the second closing force generated by the torsional spring.

The present invention also includes a method for closing a door relative to a door frame, wherein the door can assume first, second and third positions relative to the door frame, comprising: selecting a first component suitable for attaching to the door; selecting a second component, wherein the first component is movable between a first state and a second state relative to the second component; selecting means for operatively connecting the second component to the door frame, wherein the first component is movable from the first state to the second state relative to the second compartment in response to movement of the door from its first position to its second position when the first and second components are operatively disposed relative to the door and door frame; selecting means for applying a closing force between the first and second components comprising means for changing the closing force from a first closing force to a second closing force upon movement of the first component from the first state to the second state relative to the second component; selecting means operatively connected to the first and second components for selectively locking the first component in the second state relative to the second component, thereby storing the second closing force by substantially eliminating relative movement between the first and second components; operatively connecting the first and second components to the door and door frame, respectively; moving the door from its first position to its second position, thereby moving the first component from the first state to the second state and thereby changing the closing force from the first closing force to the second closing force; locking the first and second components to store the second closing force; repositioning the second component relative to the second component connecting means and moving the door from its second position to its third position; and unlocking the first and second components to restore the second closing force, wherein the second closing force is thereby associated with the door's third position relative to the door frame.

BRIEF DESCRIPTION OF THE DRAWING

FIG. 6 is an enlarged fragmentary cross sectional view of the door closer assembly of FIG. 3 taken along line 6—6 of FIG. 3, the door closer assembly being shown in its locked state.

FIG. 7 is an enlarged fragmentary cross-sectional view of the torsional door closer assembly of FIG. 6, the door closer assembly being shown in its locked state.

DETAILED DESCRIPTION OF THE INVENTION

Figure 1:
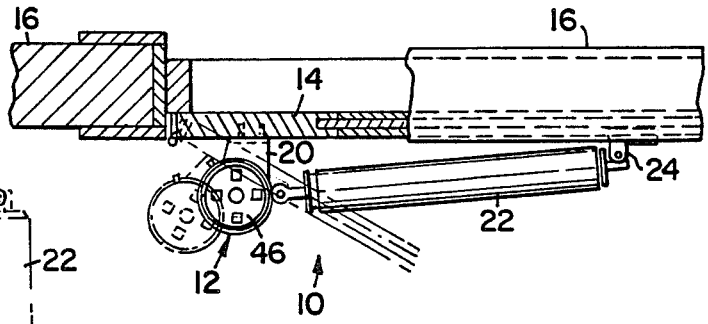
FIG. 1 is a top view showing a preferred embodiment and installation of a door closer assembly of the present invention on a righthanded, in-swinging door.
Figure 2:
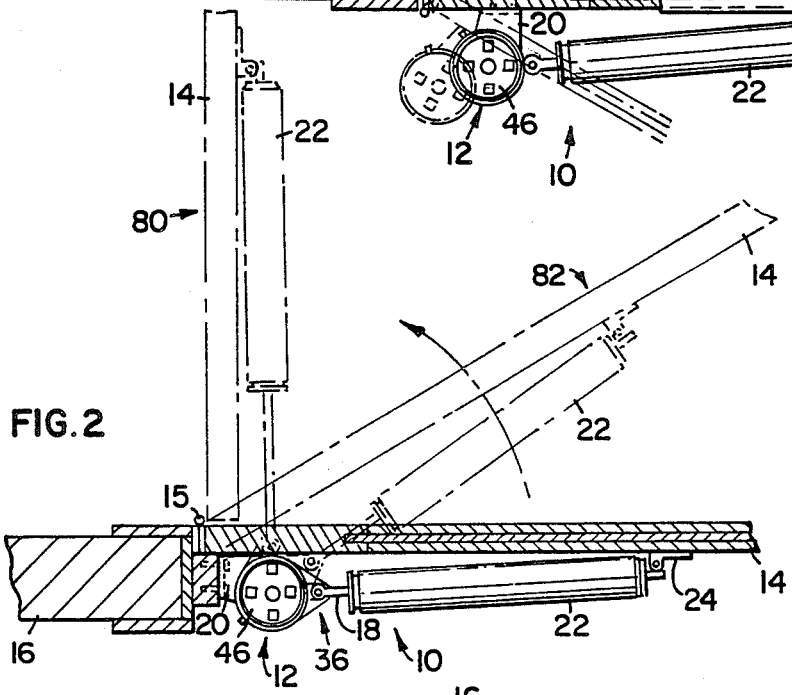
FIG. 2 is a top view the door closer assembly of FIG. 1 on a right-handed, out-swinging door.

Referring now to the Drawing wherein like reference numerals denote like elements throughout the several views, FIGS. 1–4 illustrate various attachment schemes for a door closer assembly 10, a preferred embodiment of the appartus of the present invention. Referring specifically to FIG. 2, the door closer assembly 10 preferably includes a torsional spring unit 12 which ultimately supplies a closing force between a door 14 and a door frame 16. Conventional hinges 15 attached to the door 14 and the door frame 16 permit the door to be pivoted between a closed position and various open positions.

More precisely, one component of the torsional spring unit 12 is attached to a rod 18 and another component of the spring unit 12 is operatively connected to a mounting bracket 20. Preferably, the rod 18 is a conventional rod used in conjunction with a pneumatic check device and extends substantially radially from the torsional spring unit 12. Also, preferably, the longitudinal axis of rod 18 passes through the spring unit substantially perpendicular to the collinear longitudinal axes of the cylindrical components which form the spring unit 12, further described below. A mounting bracket 24 allows the check 22 to be attached to the door 14 whereas the bracket 20 connects to the door frame 16.

Referring to FIG. 1, the mounting bracket 20 could alternatively be connected to the door 14 and the mounting bracket 24 could be attached to the door frame 16. Generally, the door closer can further comprise means for adapting it for use with any of a right-handed, left-handed, in-swinging and out-swinging door, and for providing a choice at the time of installation for strength of closing force.

The adaptability of the door closer illustrated in FIGS. 1–4 centers around the interaction between the mounting bracket 20 and the remaining components of the torsional spring unit 12. As shown in FIGS. 6 and 7, the torsional spring unit 12 preferably includes an outer cylindrical housing 34 and an inner cylindrical housing 46. The mounting bracket 20 can be positioned adjacent to the inner housing 46 or the outer housing 34.

Figure 5:
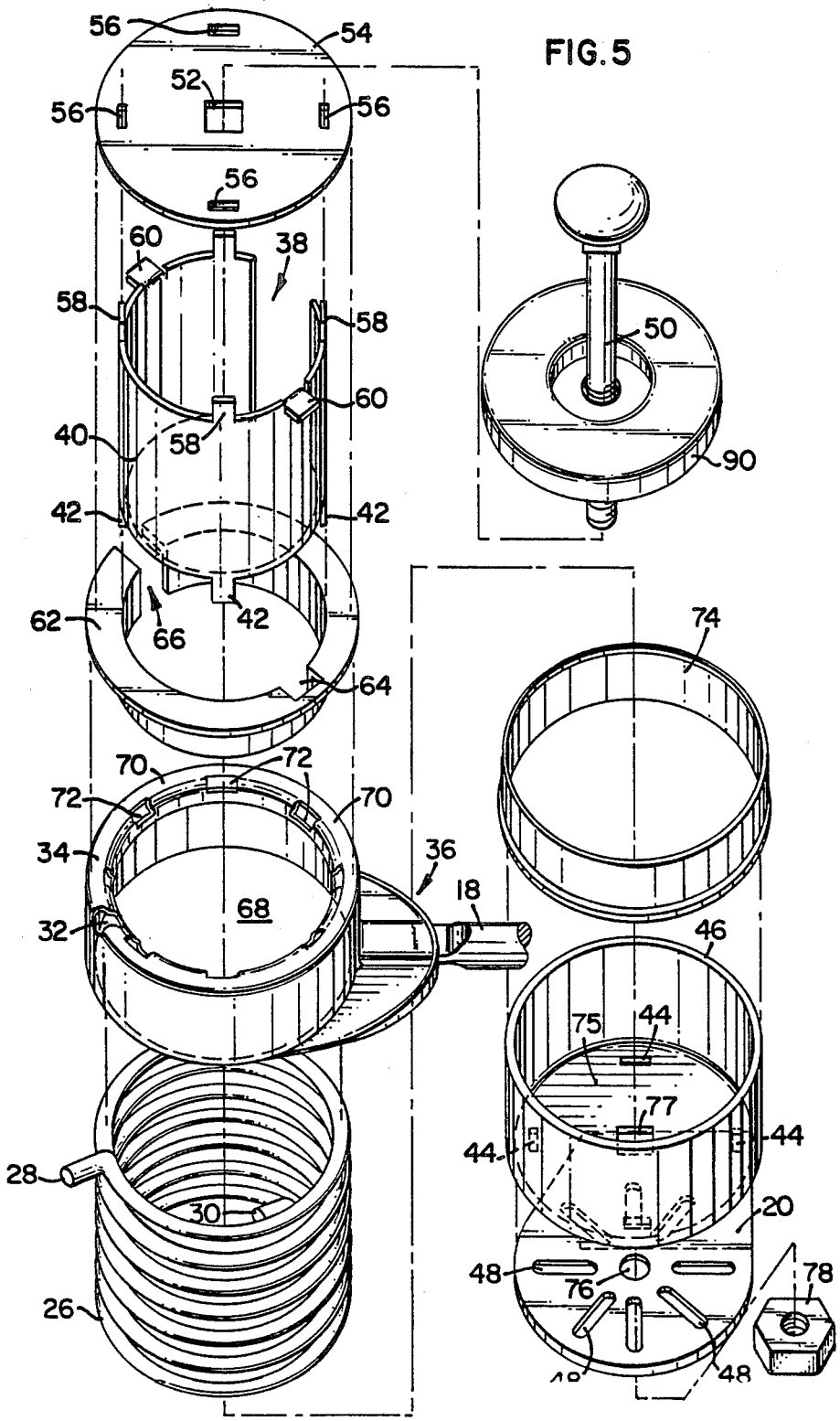
FIG. 5 is an exploded fragmentary view of the door closer assembly shown of FIG. 3.

Whether the mounting bracket 20 is attached adjacent to the inner or outer housing 46 or 34 in part determines whether the door closer assembly 10 is ready for use with a right-handed, left-handed, in-swinging or out-swinging door. Since the mounting bracket 20 can be easily attached at either end of the spring unit 12, and can be unbolted and reattached to the other end with a minimum of effort, the door closer assembly 10 can be easily adapted for use with these various door styles. Generally, for the embodiment of the spring unit 12 shown in the appended figures, the torsional spring within the spring unit 12 tightens as the outer housing 34 rotates clockwise relative to the inner housing 46 when viewed from above and the spring uncoils or loosens as the outer housing 34 moves counterclockwise relative to the inner housing 46 when viewed from above, assuming that the unit 12 is situated as shown in FIGS. 5, 6 and 7.

For the purposes of explanation, the outer housing 34 will occassionally be referred to as the "top" of the unit 12 and the inner housing 46 will be referred to as the "bottom" of unit 12. These arbitrary labels are with reference to FIGS. 5, 6 and 7 where the housings 34 and 46 are shown in this relative orientation. Clearly, however, the housing 34 is preferably atop housing 46 for left handed doors and beneath housing 46 for right handed doors, as shown in FIGS. 1–4.

FIG. 1 illustrates the installed door closer assembly 10 being used with a right-handed (hinge 15 on left), in-swinging door 14. The bracket 20 is therefore proximate the outer housing 34 of the unit 12.

FIG. 2 illustrates the door closer assembly 10 in use with a right-handed out-swinging door 14. Again, the bracket 20 is adjacent the outer housing 34 of the unit 12.

Figure 3:
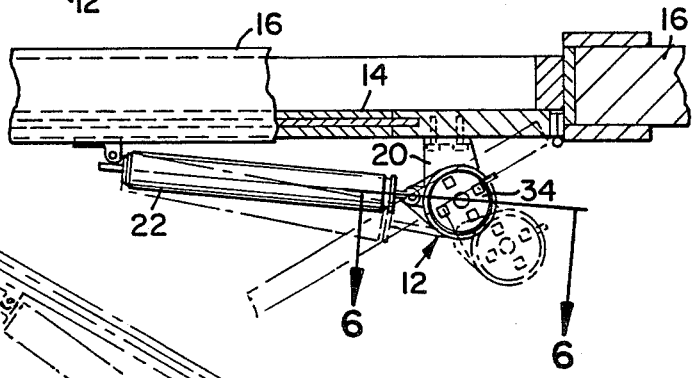
FIG. 3 is a top view showing the door closer assembly of FIG. 1 on a left-handed, in-swinging door.

FIG. 3 illustrates the use of the door closer assembly 10 with a left-handed (hinge 15 on the right side) in-swinging door 14. In this case, the inner housing 46 is proximate the mounting bracket 20.

Figure 4:
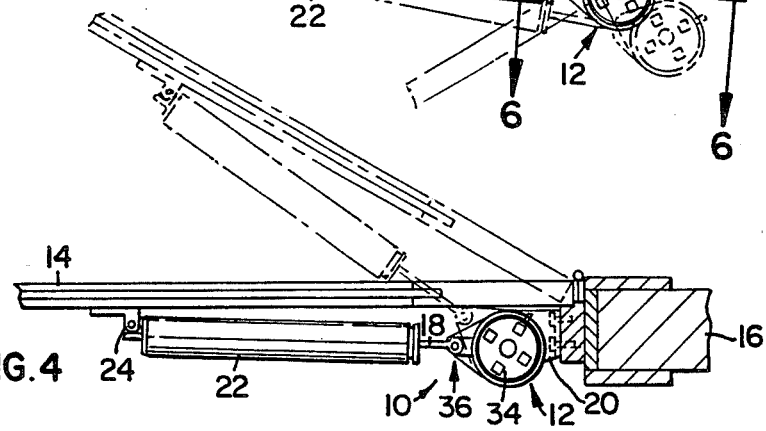
FIG. 4 is a top view showing the door closer assembly of FIG. 1 on a left-handed, out-swinging door.

Finally, FIG. 4 illustrates the use of the door closer assembly 10 with a left-handed out-swinging door 14. Again, the inner housing 46 is mounted to the bracket 20.

Several points should be made prior to discussing the spring unit 12 in greater detail. First, although the spring unit 12 is illustrated as a torsional spring unit in the appended drawing, other types of spring units are contemplated by the present invention. For example, a spring unit according to the present invention could have a linear spring which compresses in response to opening of the door. Generally, it is only necessary that spring unit 12 include some sort of resilient "substance"

capable of elastically generating the requisite closing forces.

Secondly, although the closer assembly 10 includes a pneumatic damping cylinder 22, other door closer assemblies falling within the present invention may include other types of checks, include checks integral with the spring unit, or may exclude damping devices altogether.

FIGS. 6 and 7 show enlarged cross sectional views of the torsional spring unit 12. One element of the spring unit 12 is a torsional spring 26. Spring 26 is preferably a conventional steel wire coiled spring having a radially outwardly extending upper tip 28 and a radially inwardly extending lower tip 30. The upper tip 28 of the spring 26 operatively engages a spring aperture 32 (shown in FIG. 5) formed by the cylindrical outer housing 34. The outer housing 34, preferably a unitary cylindrical element of drawn cold rolled steel, preferably partially encases the spring 26 and includes a radially extending housing extension 36 which is operatively connected to the rod 18. Thus, the upper tip 28 of the spring 26 ultimately acts on the door 14 when the closer assembly 10 is mounted as shown in FIG. 2.

The lower tip 30 of the torsional spring 26 preferably engages a longitudinal slot 38 (shown in FIG. 5) formed by a sleeve 40. The sleeve 40 is also preferably substantially cylindrical and is concentric with the outer housing 34 and the spring 26. Sleeve 40 is preferably a unitary element of punched and formed cold rolled steel.

Referring to FIGS. 5–7, a plurality of bottom lugs 42 extend downwardly from the main body of the sleeve 40. The lugs 42 are preferably evenly spaced about the lower periphery of sleeve 40 and are received by housing lug slits 44 formed in the bottom portion of a cup-like inner housing 46 which is concentric with, partially within, and slidably received by the outer housing 34. The bottom lugs 42 actually protrude through the housing lug slits 44 so as to engage radially extending bracket slots 48 formed by the mounting bracket 20. The lower tip 30 of the torsional spring 26 therefore acts on the bracket 20 which is operatively connected to the door frame 16 in the mounting scheme shown in FIG. 2, and the torsional spring 26 therefore ultimately simultaneously acts on the door 14 and the door frame 16 to provide a closing force therebetween when the door 14 is in an open position relative to the door frame 16.

It should be noted that the present invention can be applied to various types of doors, and is not limited to conventional swinging doors as shown in the appended drawing. Also, it should be noted that the phrase "door frame," as used herein, includes, but is not limited to, conventional door frames, door jambs, door stops and any other element with respect to which a door is relatively movable.

FIG. 5 shows an exploded view of the torsional spring unit 12 discussed above, clearly showing the elements discussed above as well as several elements which have yet to be expressly introduced. Starting at the top of the spring unit 12 as it is shown in FIGS. 5–7, a carriage bolt 50 extends through a round receiving hole formed by a safety cap 90 and a square receiving hole 52 formed by a circular plate 54. The longitudinal axis of the bolt 50 is coaxially aligned with the axes of the housings 34 and 46. In addition to the bolt hole 52, plate 54, also formed from cold rolled sheet steel, defines several plate lug slits 56 which are preferably radially spaced at 90° intervals around the plate 54 near its periphery. The plate lug slits 56 are sized to slidably accept top lugs 58 extending longitudinally from the body of the sleeve 40 in the same manner as, but in an opposite direction from, the bottom lugs 42 discussed above. Thus, plate 54 is substantially fixed against movement relative to sleeve 40 and inner housing 46.

The safety cap 90 forms a toroidal volume 92 (shown in FIGS. 6 and 7) which is suitable for freely receiving the top lugs 58. The top lugs 58 are thereby covered and the risk of injury, however remote, associated with the exposed top lugs 58 is eliminated. The safety cap 90 is made of molded plastic, drawn metal or other suitable material.

In addition to top and bottom lugs 58 and 42, respectively, sleeve 40 also preferably carries a pair of radially outwardly extending ears 60. Ears 60 are preferably diametrally opposed and located at the top of sleeve 40 between adjacent pairs of top lugs 58. The functional aspects of ears 60 will be addressed below.

Situated between plate 54 and outer housing 34 is a plate bearing 62. Plate bearing 62 is preferably made of nylon or the like and acts as a bearing between metal plate 54 and metal outer housing 34. Plate bearing 62 is also substantially circular in overall form and is concentric with the inner and outer housings 46 and 34, respectively.

As perhaps better shown in FIGS. 6 and 7, plate bearing 62 includes a cylindrical portion substantially parallel with the longitudinal axis of the spring unit 12 and a portion substantially perpendicular thereto. The latter portion serves as the aforementioned bearing surface.

The plate bearing 62 forms diametrally opposed ear cutout 64 and ear notch 66 suitable for receiving the ears 60 of sleeve 40.

The outer housing 34 has been described above. As shown in FIG. 5, it is preferably substantially circular but for the radially extending housing extension 36. A circular upper housing aperture 68 is formed by the ring or hoop-like outer housing 34, the aperture 68 being sized to admit the cylindrical portion of plate bearing 62, sleeve 40, and bolt 50. As noted above, with reference to FIGS. 5–7, plate 54 actually rides atop bearing 62 which in turn is supported by an upper ridge 70 of housing 34.

The upper ridge 70 is preferably a rolled upper edge of outer housing 34. The upper ridge 70 preferably forms a plurality of pairs of diametrally opposed and equally spaced ear slots 72 which accept the ears 60 of sleeve 40 in certain situations, described below. The ridge 70 also forms the spring aperture 32 suitable for accepting the upper tip 28 of spring 26.

The inner housing 46, also preferably circular, has a diameter slightly smaller than the diameter of outer housing 34 and is slidably received thereby. A nylon housing bearing sleeve 74 separates the two metal housings 34 and 46 to reduce the frictional resistance to their relative movement. The diameter of housing bearing 74 is therefore slightly larger than the diameter of inner housing 46 and is slightly smaller than the diameter of outer housing 34.

At the bottom of the unit 12, as it is shown in FIGS. 5–7, are the inner housing 46 and mounting bracket 20. The former includes a substantially circular side wall portion and a bottom circular plate 75 so that the inner housing 46 is in the nature of a small cup. The bottom circular plate 75 of inner housing 46 preferably forms a central square housing bolt hole 77. Also, the bracket 20 preferably forms a circular central bracket hole 76, the holes 74 and 76 being sized to slidably receive bolt 50. A nut 78 threads onto bolt 50 beneath bracket 20 to complete the torsional spring unit 12.

Referring again to FIGS. 5, 6 and 7, it can clearly be seen that the inner and outer housings 46 and 34, respectively, are separated by the housing bearing 74. Also, it can be seen that the housings 34 and 46 substantially encase the torsional spring 26 which preferably has a major diameter slightly smaller than the diameter of the inner housing 46 so as to be slidably received thereby. Further, the upper tip 28 of torsional spring 26 engages the upper inner surface of upper ridge 70 of outer housing 34 and the lower tip 30 of spring 26 engages the inner surface of the bottom plate 75 of the inner housing 46. Since the individual coils of the torsional spring 26 are longitudinally spaced, the torsional spring 26 also acts as a compression spring in relation to the inner and outer housings 46 and 34, respectively.

Still referring to FIGS. 5, 6 and 7, it can clearly be seen that the diameter of sleeve 40 is smaller than the diameter of torsional spring 26 and smaller than the diameter of the upper housing aperture 68 formed by the outer housing 34. Thus, the sleeve 40 fits within the torsional spring 26, the spring 26 being substantially contained within the annular space between the sleeve 40 and the housings 34 and 46.

As noted above, the present invention is directed to a door closer which can provide an adjustable door closing force. With reference primarily to FIGS. 6 and 7, the adjustment of torsional spring unit 12 will be discussed below.

FIG. 6 shows the "normal" state of the spring unit 12. In this state, housings 34 and 46 can rotate relative to one another so that spring 26 is further distorted or tensioned by the clockwise (CW) movement of outer housing 34 relative to the inner housing 46 when the unit 12 is viewed from above the plate 54. Spring 26 acts on outer housing 34 at the spring aperture 32 and acts on the sleeve 40 at slot 38. The closing force of the torsional spring 26 is transmitted on the one hand through outer housing 34, housing extension 36, rod 18, cylinder 22 and mounting bracket 24 to door 14 as shown in FIG. 2. On the other hand, the closing force generated by the spring 26 is transmitted through the sleeve 40 to inner housing 46 and mounting bracket 20 and finally to door frame 16. Referring to FIG. 2, when the door opens the torsional spring 26 is distorted and gradually develops or generates a closing force commensurate with the degree of opening of the door 14 relative to the door frame 16. Once the door 14 is released, the closing force of the torsional spring 26 urges the door 14 toward its closed position as shown in solid lines in FIG. 2.

Normally, with reference to FIG. 6, bracket 20, bolt 50 and nut 78, sleeve 40 and plate 54 are motionless with respect to one another. Outer housing 34 normally angularly moves relative to the elements listed above with the bearings 74 and 62 acting to reduce the friction between the moving components of the spring unit 12. It should also be particularly noted that ears 60 of sleeve 40 are normally not engaged with ear slots 72 formed in the upper ridge 70 of outer housing 34. The ears 60 are actually normally above the slots 72 so as not to be in contact with the outer housing 34.

With reference to FIG. 7, the closing force or pretension of the spring 26 can be easily adjusted. In order to effect this adjustment, the nut 78 is loosened in relation to bolt 50. Preferably, nut 78 is a common size, e.g., ½ inch, so that no special tools are required to adjust the pretension of the spring unit 12.

As the nut 78 is loosened, the outer housing 34 axially moves relative to the inner housing 46 so as to axially lenghten the cylindrical torsional spring unit 12. The torsional spring 26 preferably acts as a compression spring during this process to separate the housings 34 and 46 as the nut 78 is rotated. Assuming that the ears 60 of sleeve 40 are axially aligned with corresponding ear slots 72 in outer housing 34, the ears 70 will drop into corresponding slots 72 as shown in FIG. 7. Once this has occurred, housings 34 and 46 are angularly fixed relative to one another so that relative rotational movement between the housings 34 and 46 is prevented.

Thus the housings 34 and 46 are angularly locked together and the tension in torsional spring 26, whatever it might be at the time of adjustment, is "stored." Once the tension is stored, the housings 34 and 46 can be readily rotated as a unit relative to mounting bracket 20 to a new position corresponding to a different degree of opening of the door 14 relative to the door frame 16. Once the new relationship between the housings 34 and 46 and the mounting bracket 20 is established the nut 78 is retightened to compress the housings 34 and 46 together as shown in FIG. 6. The ears 60 are drawn out of the slots 72 and the closing force is "restored": the torsional spring unit 12 thereafter functions normally to resist opening of the door 14 relative to the door frame 16.

Referring to FIG. 2, a preferred adjustment process or method can proceed as follows: when the door 14 is in its closed position (shown in solid lines), the torsional spring 26 typically exerts little if any closing force (at least prior to adjustment). The door 14 can then be moved to its second position illustrated as its fully opened position in FIG. 2, designated with the reference numeral 80. Once moved to this second position 80, the housings 34 and 46 can be locked together using the process discussed above. That is, the nut 78 can be loosened from bolt 50 so as to allow the axial expansion of the housings 34 and 46 and to permit the ears 60 of sleeve 40 to drop into ear slots 72 so as to rotationally lock the housings 34 and 46 together.

Once the housings 34 and 46 are locked together, the door 14 can be repositioned to a third position designated with the reference numeral 82 in FIG. 2. Following the repositioning of door 14 relative to door frame 16, the housings 34 and 46 can again be compressed to their "normal" state as shown in FIG. 5 to permit relative rotational movement therebetween. It can therefore be seen that the closing force or tension which was formerly associated with the second position 80 of the door 14 can be easily associated with the third position 82 of the door 14 so that the spring 26 is in effect pretensioned. Following the adjustment process as described above, once the door 14 closes the spring 26 typically continues to exert a closing force, so that even in its closed position the door 14 is subjected to a closing force.

It should be noted that the expanded housings 34 and 46, shown in FIG. 7, can be freely rotated relative to the mounting bracket 20 once the nut 78 is loosened since the force exerted by the bottom surface of the bottom plate 75 on the upper surface of the mounting bracket 20 is considerably reduced. The bottom lugs 42 will tend to slide out of the corresponding receiving slots 48 in the bracket 20 when the housings 34 and 46 are expanded in the fashion illustrated in FIG. 7.

Alternatively, the nut 78 can be completely removed from bolt 50 so as to effectively remove any compressional forces between the bottom of plate 75 and the top of mounting bracket 20. In this case, the bottom lugs 42 will very easily slip out of corresponding slots 48 in the bracket 20 to allow realignment of the inner housing 46 relative to the mounting bracket 20. It should be noted that for the embodiment shown in FIGS. 5-7 the inner housing 46 only has a limited number of discrete positions relative to the bracket 20 due to the limited number of slots 48 in the bottom bracket 20. It is envisioned, however, that there could be other interconnection schemes between the inner housing 46 and the bracket 20 which would allow for a much larger number of possible relative alignments between these two elements of the door closer assembly 10.

In addition, the safety cap 90 can be repositioned adjacent housing 46 when the housing 46 is positioned atop housing 34. When the cap 90 is in this position, it freely accepts bottom lugs 42 rather than lugs 58. In summary, cap 90 encases the lugs 42 or 58, depending on which housing 34 or 46 is adjacent bracket 20.

It should also be noted that the adjustment process can be accomplished by disengaging the check 22 from the door 14 (or door frame 16) after the nut 78 is loosened. Once the locked spring unit 12 is repositioned, the check 22 can be reattached to the door 14 (or door frame 16).

It should be emphasized that the present invention is not limited to any particular materials or combination of materials, and modifications of the invention will be apparent to those skilled in the art in light of the foregoing description. This description is intended to provide specific examples of individual embodiments which clearly disclose the present invention. Accordingly, the invention is not limited to these embodiments or to the use of elements having the specific configurations and shapes as presented herein. All alternative modifications and variations of the present invention which fall within the spirit and broad scope of the appended claims are included.

I claim:

1. A door closer suitable for operatively connecting to first and second door assembly portions, wherein the first door assembly portion can assume first, second and third positions relative to the second door assembly portion, said door closer comprising:

(a) a first component;

(b) a second component, wherein said first component is movable between a first state and a second state relative to said second component;

(c) means for operatively connecting said first component to the first door assembly portion;

(d) means for operatively connecting said second component to the second door assembly portion, wherein said first component is movable from said first state to said second state relative to said second component in response to movement of the first door assembly portion from its first position to its second position relative to the second door assembly portion when said door closer is operatively connected to the first and second door assembly portions;

(e) means for applying a closing force between said first and second components comprising means for changing said closing force from a first closing force to a second closing force upon movement of said first component from said first state to said second state relative to said second component;

(f) means operatively connected to said first and second components for selectively locking said first component in said second state relative to said second component, thereby storing said second closing force by substantially eliminating relative movement between said first and second components;

(g) means operatively connected to said second component and said second component connecting means for selectively allowing relative movement therebetween, wherein the first door assembly portion can be selectively freely moved from its second position to its third position relative to the second door assembly portion when said door closer is operatively disposed relative to the first and second door assembly portions;

(h) means operatively connected to said first and second components for selectively unlocking said first and second components, thereby selectively allowing relative movement therebetween and restoring said second closing force, wherein said second closing force can be selectively associated with the third position of the first door assembly portion relative to the second door assembly portion when said door closer is operatively disposed relative to the first and second door assembly portions, the first door assembly portion comprising a door and the second door assembly portion comprising a door frame; and (i) said door closer being a torsional door closer; wherein said closing force applying means comprises a torsional spring having a longitudinal axis and first and second ends; wherein said first component comprises a first housing assembly and said second component comprises a second housing assembly; said first and second housing assemblies are coaxially aligned with and substantially encase said torsional spring; said first end of said torsional spring operatively engages said first housing assembly and said second end of said torsional spring operatively engages said second housing assembly; wherein said first and second housing assemblies are slidably engaged and normally rotatable with respect to one another and said first housing assembly comprises a first substantially cylindrical housing coaxially aligned with said torsional spring, and said first housing forms a plurality of locking slots and a first spring aperture suitable for receiving he first end of said torsional spring; said second housing assembly comprises a second substantially cylindrical housing and a sleeve operatively connected to said second housing, wherein said sleeve is fixed against rotation relative to said second housing and forms a second spring aperture suitable for receiving the second end of said torsional spring; said locking means comprises said sleeve and a locking ear extending therefrom; and wherein said first and second housings are selectively locked by operatively engaging said locking ear and one of said locking slots.

2. The door closer according to claim 1, wherein said locking means further comprises a male threaded member axially aligned with said axially aligned first and second housings, sleeve and torsional spring, and a female threaded member positioned without said first and second housings, wherein said male and female threaded members can be increasingly threadedly engaged to axially draw said first and second housings toward one another to thereby cause said locking ear of said sleeve to operatively engage said one of said locking slots.

3. A door closer suitable for operatively connecting to a door and a door frame, wherein the door can assume first, second and third positions relative to the door frame, said door closer comprising:

(a) a first component suitable for operatively connecting to the door;

(b) a second component, wherein said first component is movable between a first state and a second state relative to said second component;

(c) means for operatively connecting said second component to the door frame, wherein said first component is moveable from said first state to said second state relative to said second component in response to movement of the door from its first position to its second position when said door closer is operatively connected to the door and door frame;

(d) resilient means for applying a closing force between said first and second components, wherein said closing force changes from a first closing force to a second closing force upon movement of said first component from said first state to said second state relative to said second component;

(e) means operatively connected to said first and second components for selectively locking said first component to said second component;

(f) means operatively connected to said second component and said second component connecting means for selectively allowing relative motion therebetween, wherein when said door closer assembly is operatively disposed relative to the door and door frame said first and second components can be selectively locked to store said second closing force, the door can be freely moved to its third position, and said second closing force can be restored, thereby associating said second closing force with the door's third position; and (g) said door closer is a torsional door closer, said closing force applying means comprising a torsional spring having a longitudinal axis and first and second ends, wherein said first component comprises a first housing assembly and said second component comprises a second housing assembly; said first and second housing assemblies are coaxially aligned with and substantially encase said torsional spring; said first end of said torsional spring operatively engages said first housing assembly and said second end of said torsional spring operatively engages said second housing assembly; and wherein said first and second housing assemblies are slidably engaged and normally rotatable with respect to one another; said first housing assembly comprising a first substantially cylindrical housing coaxially aligned with said torsional spring, and said first housing forming a plurality of locking slots and first spring aperture suitable for receiving the first end of said torsional spring; said second housing assembly comprising a second substantially cylindrical housing and a sleeve operatively connected to said second housing, wherein said sleeve is fixed against rotation relative to said second housing and forms a second spring aperture suitable for receiving the second end of said torsional spring; said locking means comprising said sleeve and a locking ear extending therefrom; and wherein said first and second housings are selectively locked by operatively engaging said locking ear and one of said locking slots.

4. The door closer according to claim 3, wherein said locking means further comprises a male threaded member axially aligned with said axially aligned first and second housings, sleeve and torsional spring, and a female threaded member positioned without said first and second housings, wherein said male and female threaded members can be increasingly threadedly engaged to axially draw said first and second housings toward one another to thereby cause said locking ear of said sleeve to operatively engage said one of said locking slots.

5. A door closer suitable for operatively connecting to a door and a door frame, comprising:

(a) a first component suitable for operatively connecting to the door;

(b) a second component, wherein said first component is movable between a first state and a second state relative to said second component;

(c) means for operatively connecting said second component to the door frame, wherein said second component is selectively movable from a first position to a second position relative to said second component connecting means;

(d) resilient means for applying a closing force between said first and second components, wherein said closing force changes from a first closing force to a second closing force upon movement of said first component from said first state to said second state relative to said second component;

(e) means operatively connected to said first and second components for selectively locking said first component to said second component when said first component is in said second state relative to said second component, wherein when said first and second components are locked together said second component can be moved relative to said second component connecting means and said first and second components unlocked to thereby associate said second closing force with said second position of said second component relative to said second component connecting means; and (f) said door closer being a torsional door closer wherein said closing force applying means comprises a torsional spring having a longitudinal axis and first and second ends and wherein said first component comprises a first housing assembly and said second component comprises a second housing assembly; said first and second housing assemblies are coaxially aligned with and substantially encase said torsional spring; said first end of said torsional spring operatively engages said first housing assembly and said second end of said torsional spring operatively engages said second housing assembly; wherein said first and second housing assemblies are slidably engaged and normally rotatable with respect to one another, and wherein said first housing assembly comprises a first substantially cylindrical housing coaxially aligned with said torsional spring, and said first housing forms a plurality of locking slots and a first spring aperture suitable for receiving the first end of said torsional spring; said second housing assembly comprises a second substantially cylindrical housing and a sleeve operatively connected to said second housing, wherein said sleeve is fixed against rotation relative to said second housing and forms a second spring aperture suitable for receiving the second end of said torsional spring; said locking means comprises said sleeve and a locking ear extending therefrom; and wherein said first and second housings are selectively locked by operatively engaging said locking ear and one of said locking slots.

6. The door closer according to claim 5, wherein said locking means further comprises a male threaded member axially aligned with said axially aligned first and second housings, sleeve and torsional spring, and a female threaded member positioned without said first and second housings, wherein said male and female threaded members can be increasingly threadedly engaged to axially draw said first and second housings toward one another to thereby cause said locking ear of said sleeve to operatively engage said one of said locking slots.

7. The door closer according to claim 6, wherein said second housing assembly further comprises a top plate slidable relative to said first housing which forms a first bolt aperture and which forms a plurality of top lug apertures; wherein said second housing forms a plurality of bottom lug apertures and a second bolt aperture; wherein said sleeve comprises a plurality of top lugs operatively engaged with said top lug apertures and a plurality of bottom lugs operatively engaged with said bottom lug apertures; and wherein the door closer further comprises a safety cap in operative contact with said top plate suitable for encasing said top lugs.

8. The door closer according to claim 7, wherein said second connecting means comprises a bracket suitable for receiving the top lugs or the bottom lugs, wherein said slidably engaged housing assemblies can be flipped as a unit to operatively engage said top lugs with said bracket in which case said safety cap can be removed from contact with said top plate and placed in operative contact with said second housing to encase said bottom lugs.

* * * * *